US006277085B1

(12) United States Patent
Flynn

(10) Patent No.: US 6,277,085 B1
(45) Date of Patent: Aug. 21, 2001

(54) SOLENOIDAL SKIN VIBRATOR ENERGIZED BY COMPLEX ELECTRIC WAVEFORMS

(76) Inventor: Michael P. Flynn, 50 Dhu Varren Rd., Ann Arbor, MI (US) 48105

( * ) Notice: Subject to any disclaimer, the term of this patent is extended or adjusted under 35 U.S.C. 154(b) by 0 days.

(21) Appl. No.: 09/328,745

(22) Filed: Jun. 9, 1999

Related U.S. Application Data

(60) Provisional application No. 60/088,619, filed on Jun. 9, 1998.

(51) Int. Cl.[7] ..... A61H 01/00
(52) U.S. Cl. ..... 601/80; 601/78
(58) Field of Search ..... 601/46, 67–73, 601/78–84

(56) References Cited

U.S. PATENT DOCUMENTS

| | | | | |
|---|---|---|---|---|
| 2,675,800 | * | 4/1954 | Voorhees et al. | 601/72 |
| 3,727,607 | * | 4/1973 | Dil | 601/57 |
| 5,007,410 | * | 4/1991 | DeLaney | 601/53 |
| 5,165,814 | * | 11/1992 | Buda | 601/80 |
| 5,471,695 | * | 12/1995 | Aiyar | 15/22.1 |
| 6,001,072 | * | 12/1999 | Fujiwara | 601/47 |

FOREIGN PATENT DOCUMENTS

| | | | | |
|---|---|---|---|---|
| 065598 | * | 3/1950 | (CH) | 601/80 |
| 306783 | * | 4/1994 | (CH) | 601/80 |
| 558592 | * | 9/1932 | (DE) | 601/80 |
| 1069323 | * | 7/1954 | (FR) | 601/80 |
| 406120866 | * | 4/1994 | (JP) | 601/78 |

* cited by examiner

*Primary Examiner*—Justine R. Yu
(74) *Attorney, Agent, or Firm*—James M. Deimen

(57) ABSTRACT

A new skin vibrator converts simple or complex electrical waveforms into simple or complex mechanical waveforms or vibrations that are applied to the skin and underlying tissues for therapy or pleasure. The complex waveforms may be completely random in response to the output of a random electrical noise generator, or non-random but complex in response to music or speech. In effect, random acoustic vibrations or speech or musical vibrations are induced in the skin and underlying tissues. The vibrator comprises an oblong hollow body having a solenoidal motor mounted inside. The solenoid is partially damped at both extremes of its stroke to buffer the impact within the vibrator and thereby soften the vibration. Wires extend from the vibrator for connection with a signal generator, audio amplifier or other source of the electrical waveforms.

11 Claims, 3 Drawing Sheets

SOLENOIDAL SKIN VIBRATOR ENERGIZED BY COMPLEX ELECTRIC WAVEFORMS

This application is a complete application based on Provisional Patent Application Ser. No. 60/088,619 filed Jun. 9, 1998.

BACKGROUND OF THE INVENTION

The field of the invention pertains to vibrators that stimulate the skin and underlying tissue for medicinal treatment or for sensual pleasure. In particular, the invention pertains to small hand held electric massagers and vibrators that are held against the skin for treatment or pleasure.

Heretofore, electrical and mechanical skin vibrators have been designed to operate at a single constant amplitude and frequency or, with selection means, at any one of several preset constant amplitudes and frequencies. Thus, the user could adjust the frequency and amplitude to a different setting if desired, however the choice of settings was limited and unmodulated.

SUMMARY OF THE INVENTION

The new skin vibrator converts simple or complex electrical waveforms into simple or complex mechanical waveforms or vibrations that are applied to the skin and underlying tissues. The complex waveforms may be completely random in response to the output of a random electrical noise generator, or non-random but complex in response to music or speech. In effect, random acoustic vibrations or musical vibrations are induced in the skin and underlying tissue.

The new skin vibrator comprises a generally tubular or oblong hollow body closed at one end. Adjacent the closed end is an electric solenoid having a relatively heavy permanent magnet solid rod within the solenoid. The solid rod is free to move back and forth along the solenoidal axis but is constrained to remain within the solenoid by resilient partial damping means at each end of the solenoid. The damping means also contact the inside wall of the tubular body.

Attached to the solenoid are a pair of wires leading from the tubular body open end and connected to a signal generator or loudspeaker electric driver output. In an alternative embodiment the body is oblong and closed at both ends with the wires exiting the body at one end.

DESCRIPTION OF THE PREFERRED EMBODIMENTS

Figure 1:
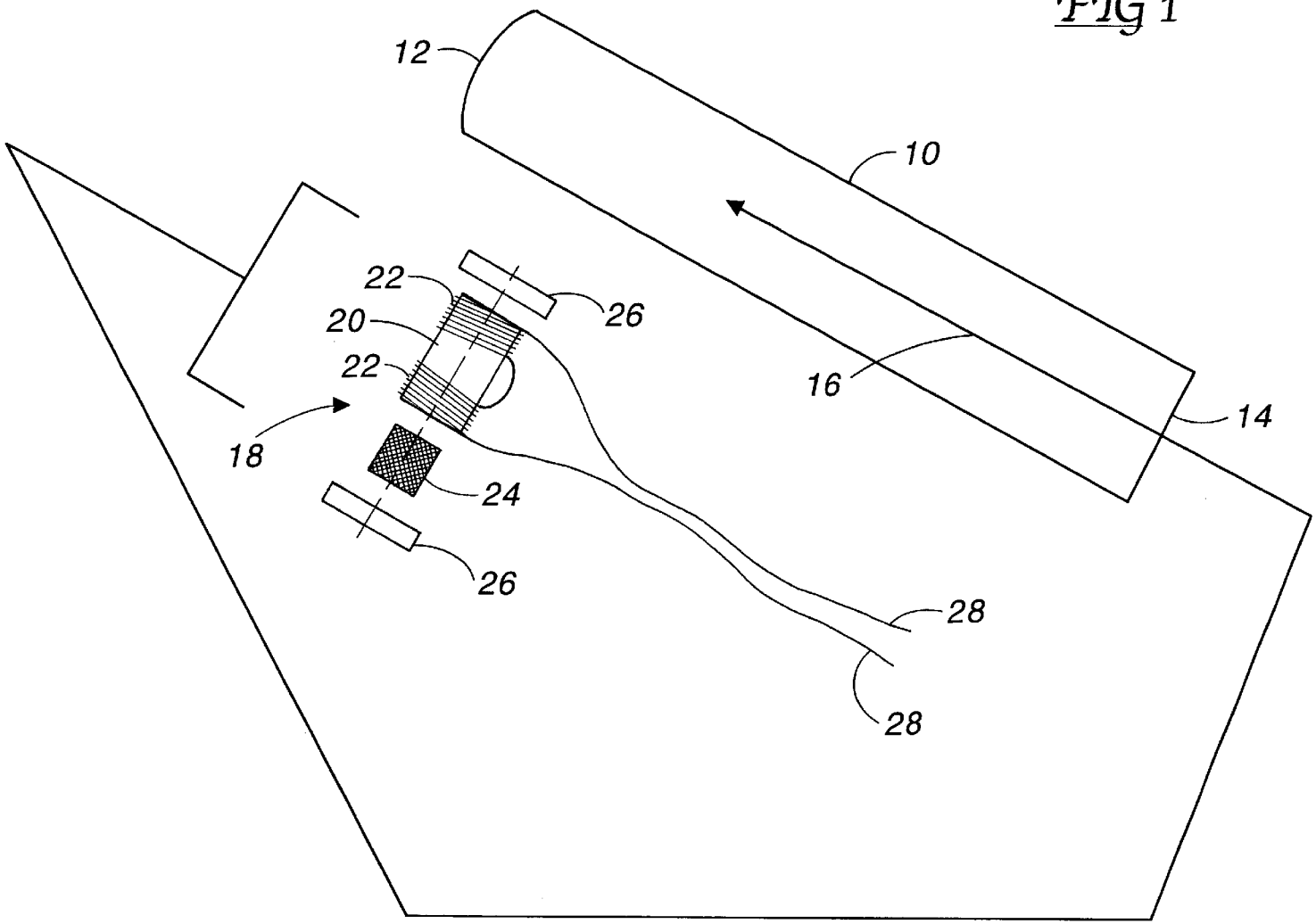
FIG. 1 illustrates the assembly of the tubular vibrator in exploded view.

Illustrated in FIG. 1 is a first tube 10 having a closed end 12 and an open end 14. Inserted into the tube 10 as indicated by arrow 16 is an electromechanical motor in the form of a solenoid generally denoted by 18. The solenoid comprises a solenoid tube 20 electrically wound 22 to cause a solid cylindrical permanent magnet 24 therein to reciprocate within the solenoid tube.

Capping each end of the solenoid tube 20 is a pair of foam plastic discs 26. The foam plastic discs 26 prevent the magnet 24 from directly contacting the inside wall of the tube 10. The foam plastic of the discs 26 is selected to partially damp the transmission of the reaction forces communicated from the solenoid tube 20 to the first tube 10.

Figure 2:
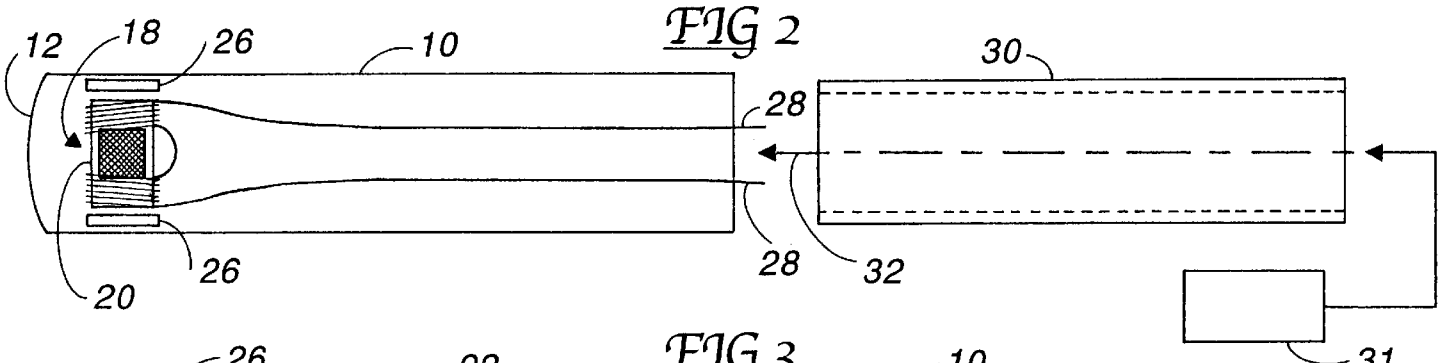
FIG. 2 illustrates in cross-section the final assembly of the vibrator.

As shown in FIG. 2 the solenoid 18 is located adjacent the tube end 12 with the discs 26 wedging the solenoid tube 20 transversely inside the first tube 10. The electric winding 22 includes a pair of wires 28 extending from the first tube 10. The wires 28 extend through a foam tube 30 which fits inside the first tube 10 as indicated by arrow 32.

Figure 3:
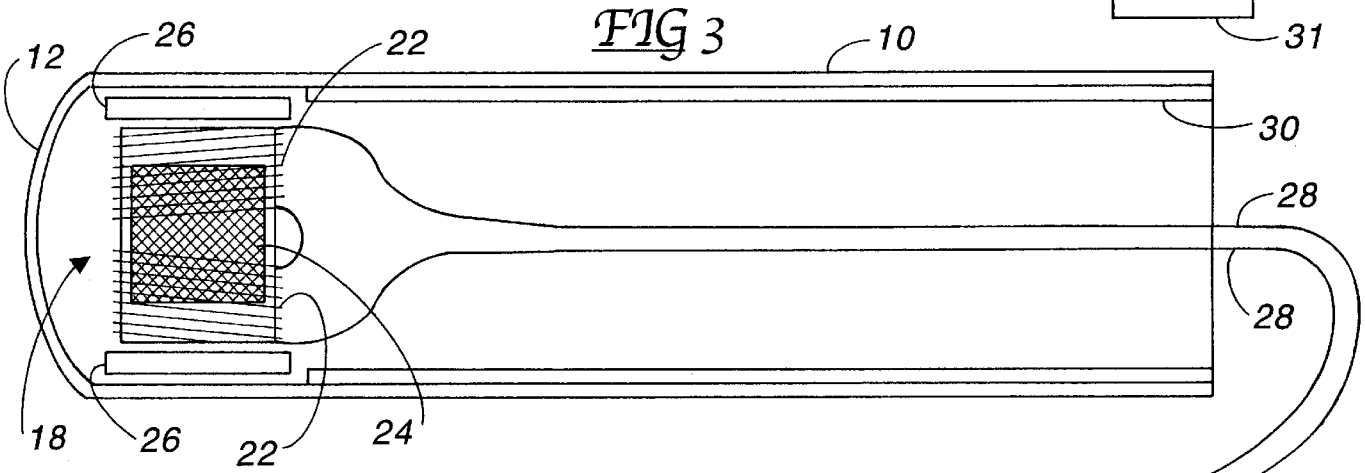
FIG. 3 illustrates in cross-section the assembled vibrator.

The final assembly of the vibrator is shown in FIG.3. The wires 28 may be connected to an electric signal generator 29 or output of an audio amplifier such as a loudspeaker driver circuit. Other alternatives may be the radio speaker driver circuit output such as from a car radio or portable transistor radio. As a further alternative a battery powered random or programmed solid state signal generator or a radio may be built into the interior of the foam tube 30 as illustrated at 31 in FIG. 2. In any of these versions the signal generator could be used to induce standing waves of known amplitude and frequency for medical diagnosis and therapy. Also the foam tube 30 may be constructed of foam plastic sponge and left open for insertion of a finger or other bodily appendage.

In constructing the electric winding 22 one end is wound clockwise and the other end is wound counterclockwise as shown in FIG. 3 with the magnet 24 axially magnetized. Thus, the magnet 24 is caused to reciprocate in response to the electromagnetic signal imposed thereon without settling into a neutral position.

Figure 4:
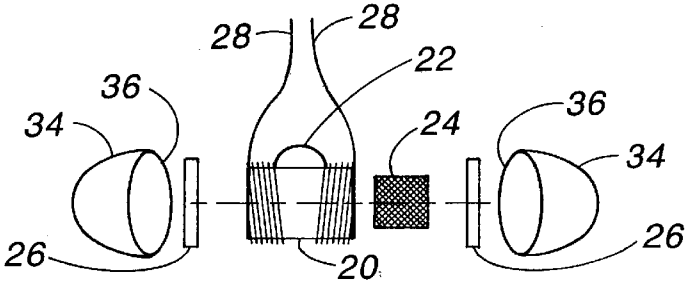
FIG. 4 illustrates an alternative oblong construction of the vibrator.

Illustrated in FIG. 4 is a modification of the external body of the vibrator wherein the solenoid tube 20, magnet 24 and winding 22 are covered by a pair of end covers 34 forming an egg shaped cover over the solenoid driver. Either of the end covers 34 may be used to contact the skin. The wires 28 exit the vibrator at the joint 36 between the end covers 34. As above the foam discs 26 wedge the solenoid 18 against the insides of the end covers 34 to transmit partially damped vibrations to the end covers generally in the direction of the major axis of the vibrator. Returning to FIGS. 1 through 3 the solenoid 18 may be positioned for axial movement of the magnet 24 relative to the tube 10 as an alternative to transverse movement.

Figure 5:
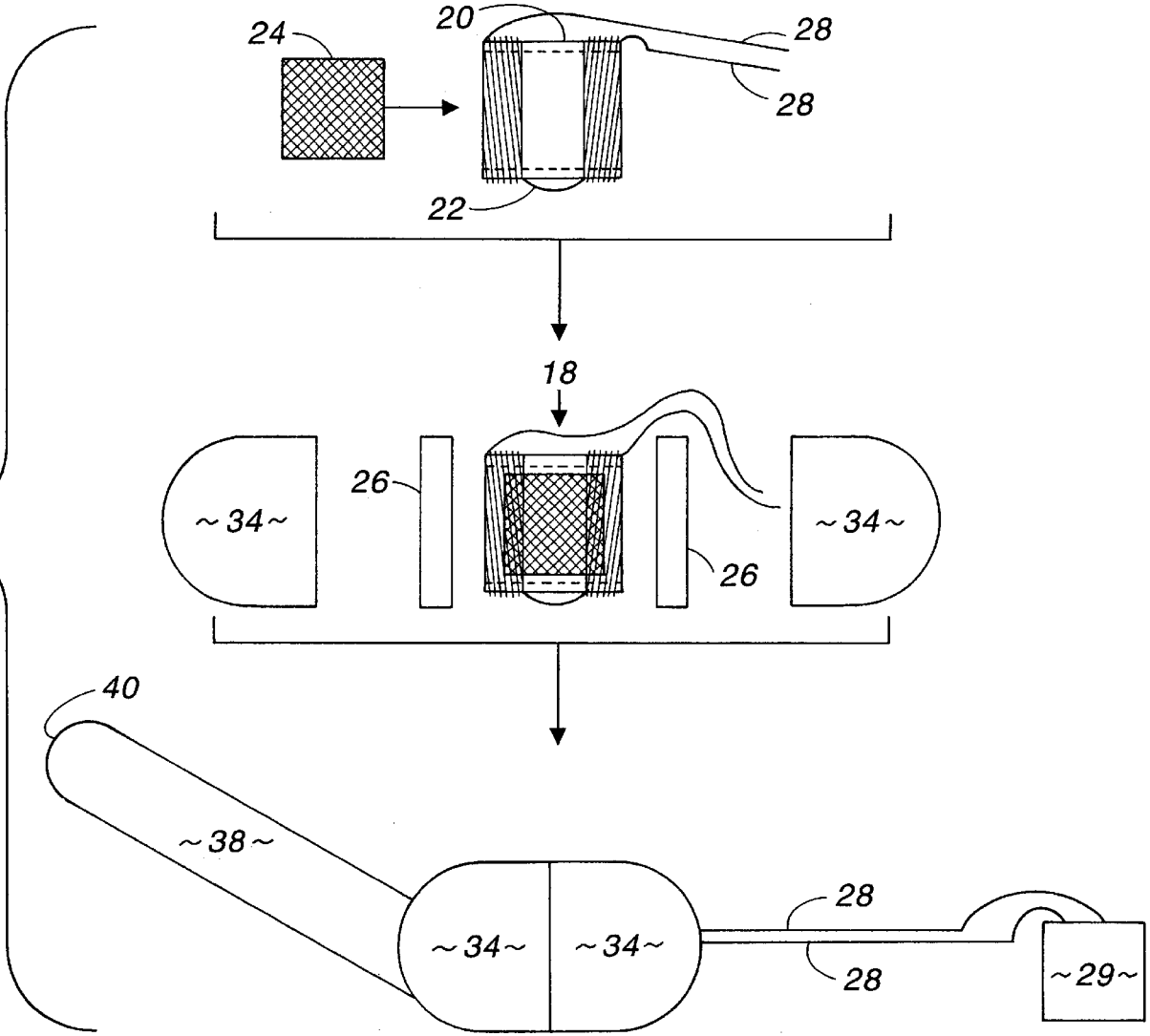
FIG. 5 illustrates a second alternate embodiment of the vibrator.

In FIG. 5 a further alternate embodiment of the vibrator is illustrated as a series of assembly steps. As shown the magnet 24 is inserted in the solenoid tube 20 which is wound for reciprocating movement. The solenoid 18 is then positioned between the two foam discs 26 and this assembly is inserted into the end covers 34 with the wires 28 extending through one end cover. The other end cover 34 has permanently attached thereto a hollow appendage 38 having a hemispherical closed end 40. Application of an electrical signal from a signal generator 29 or other source as explained above will cause vibration of the device, in particular, the appendage 38. The appendage 38 is angularly offset from the major axis of the end covers 34 to impart some transverse vibration to the appendage from axial movement imparted by the solenoid 18.

What is claimed is:

1. A skin vibrator comprising an oblong tubular hollow body, an electromechanical solenoid in the hollow body and positioned to impart a complex mechanical vibration to the hollow body in response to a complex electrical signal applied to the solenoid and damping means communicating with the hollow body and the solenoid to soften the complex mechanical vibration imparted to the hollow body, wherein the solenoid is positioned adjacent one end of the hollow body, and a foam tube is coaxially positioned in the hollow body.

2. The skin vibrator of claim 1 wherein the tubular hollow body has an axis therethrough and the solenoid is positioned to impart vibration transverse to the axis of the tubular hollow body.

3. The skin vibrator of claim 2 wherein the damping means are located at the opposite ends of the solenoid.

4. The skin vibrator of claim 1 wherein the solenoid is coaxial with the tubular hollow body and the damping means is located at each end of the solenoid.

5. The skin vibrator of claim 4 including means to generate complex electrical waveform in electrical communication with the solenoid.

6. The skin vibrator of claim 1 wherein the hollow body is egg-shaped with a longitudinal major axis.

7. The skin vibrator of claim 6 wherein the solenoid is positioned to impart vibration co-axial with the major axis of the hollow body.

8. The skin vibrator of claim 7 wherein the damping means are located at the opposite ends of the solenoid.

9. The skin vibrator of claim 8 including complex electrical waveform generation means in electrical communication with the solenoid.

10. The skin vibrator of claim 6 including an appendage attached to an end of the hollow body.

11. The skin vibrator of claim 10 wherein the appendage is angularly offset from the major axis of the hollow body.

* * * * *